US008684234B2

(12) United States Patent
Bacellar et al.

(10) Patent No.: US 8,684,234 B2
(45) Date of Patent: Apr. 1, 2014

(54) APPARATUS AND METHOD FOR DELIVERY OF A DRY MIXTURE

(75) Inventors: Ricardo Bacellar, Curitiba (BR); Cristiano Fernandes, Curitiba (BR); Joao Mauricio Magalhaes Moreira, Coral Gables, FL (US); Vanessa Poletti Ferreira Olivatti, Campo Largo (BR); Antonio Paulo Pivesso, Jr., Campo Largo (BR)

(73) Assignee: Kraft Foods Group Brands LLC, Northfield, IL (US)

( * ) Notice: Subject to any disclaimer, the term of this patent is extended or adjusted under 35 U.S.C. 154(b) by 81 days.

(21) Appl. No.: 13/196,023

(22) Filed: Aug. 2, 2011

(65) Prior Publication Data

US 2012/0037660 A1 Feb. 16, 2012

(30) Foreign Application Priority Data

Aug. 4, 2010 (BR) ..... 1003166

(51) Int. Cl.
*B67D 7/78* (2010.01)

(52) U.S. Cl.
USPC ..... 222/145.6; 222/1; 222/145.1; 222/145.5

(58) Field of Classification Search
USPC ..... 222/1, 140, 145.1, 311, 236–242, 222/410–412, 145.6, 333, 145.5; 141/9, 34, 141/105, 256; 366/145.62, 157.1–157.4, 366/239, 319, 178.1, 76.4; 137/896–898; 239/650, 673, 675, 398, 432; 198/608
See application file for complete search history.

(56) References Cited

U.S. PATENT DOCUMENTS

| | | | | | |
|---|---|---|---|---|---|
| 914,973 | A | * | 3/1909 | Pickett | 222/134 |
| 1,072,143 | A | * | 9/1913 | Mills | 366/9 |
| 1,546,360 | A | * | 7/1925 | Bates | 53/451 |
| 1,566,493 | A | * | 12/1925 | McKay | 414/143.1 |
| 1,725,226 | A | * | 8/1929 | Taylor | 241/101.6 |
| 2,189,018 | A | * | 2/1940 | Robinson | 222/311 |
| 2,791,355 | A | * | 5/1957 | Morgan, Jr. | 222/411 |
| 2,816,518 | A | * | 12/1957 | Daggett | 222/145.6 |
| 3,441,225 | A | * | 4/1969 | Barth et al. | 239/683 |
| 3,658,212 | A | * | 4/1972 | Ullberg | 222/240 |
| 4,033,514 | A | * | 7/1977 | Weiss et al. | 239/662 |
| 4,044,803 | A | * | 8/1977 | Baker | 141/34 |
| 4,194,844 | A | | 3/1980 | Walling | |

(Continued)

FOREIGN PATENT DOCUMENTS

| | | |
|---|---|---|
| CA | 1059473 | 7/1979 |
| JP | 07299345 | 11/1995 |

*Primary Examiner* — Paul R Durand
*Assistant Examiner* — Randall Gruby
(74) *Attorney, Agent, or Firm* — Fitch, Even, Tabin & Flannery LLP

(57) ABSTRACT

A method of measuring or dosing dry mixture ingredients includes providing separate flow channels for ingredients. The flow channels including at least a first flow channel and a second flow channel configured such that the first flow channel is at least partially disposed around the second flow channel. The first flow channel may include an outer concentric metering screw and the second flow channel may include an inner concentric metering screw. The method further including providing a first material to the first flow channel and a second material to a second flow channel, wherein one of the first and second materials comprises a single dry ingredient and the other of the first and second material comprises multiple dry ingredients. The materials are advanced through the channels to a shared exit where a mixing zone is provided.

19 Claims, 4 Drawing Sheets

(56) References Cited

U.S. PATENT DOCUMENTS

| | | | | | |
|---|---|---|---|---|---|
| 4,199,108 | A | * | 4/1980 | Baumgartner et al. | 239/662 |
| 4,232,973 | A | | 11/1980 | Ligouzat | |
| 4,358,207 | A | | 11/1982 | Roth | |
| 4,426,018 | A | * | 1/1984 | Ward | 222/1 |
| 4,433,707 | A | * | 2/1984 | Farnham | 141/1 |
| 4,443,109 | A | | 4/1984 | Watts | |
| 4,883,363 | A | * | 11/1989 | Pillon et al. | 366/157.4 |
| 5,423,455 | A | * | 6/1995 | Ricciardi et al. | 222/1 |
| 5,527,107 | A | | 6/1996 | Weibel et al. | |
| 5,913,602 | A | | 6/1999 | Steele | |
| 5,950,868 | A | * | 9/1999 | Wegman | 222/1 |
| 7,028,448 | B2 | * | 4/2006 | Engesser et al. | 53/451 |
| 2004/0020941 | A1 | | 2/2004 | Engesser et al. | |

* cited by examiner

APPARATUS AND METHOD FOR DELIVERY OF A DRY MIXTURE

CROSS-REFERENCE TO RELATED APPLICATION

This application claims priority from Brazilian Patent Application No. PI 1003166-9, filed Aug. 4, 2010, which is hereby incorporated herein by reference in its entirety.

TECHNICAL FIELD

This invention relates generally to an apparatus and method for measuring and mixing ingredients. More specifically, it relates to the dosing of dry mixture ingredients.

BACKGROUND

Powdered mixtures of dry ingredients are used in many applications including manufacturing and food processing, to note but a few. Depending on the desired powdered mixture, a number of mixing steps may be employed to obtain the desired final product. For example, several ingredients may be mixed in a first mixing step prior to mixing with other ingredients in subsequent mixing steps. Such staged mixing helps to prepare the mixture and eliminates extra mixing time that may result when large and different amounts of ingredients are all mixed together at one time.

Since different powdered ingredients may have widely varying properties, such powdered ingredients may respond quite differently to the same conditions. For example, powdered mixtures may have components with different particle size distributions and with different flow characteristics such that some of the ingredients may segregate out in normal flow channels. The staged mixing of ingredients may not be able to adequately accommodate mixtures with widely differing ingredient characteristics. Indeed, some mixtures may have constituent ingredients that will segregate out in normal flow channels even if those ingredients are not added until later mixing stages. Nonetheless, even if the ingredients do not segregate out, the staged mixing may still be problematic if a large quantity of powdered ingredients is to be mixed because a significant amount of time is often required to thoroughly mix larger volumes. Significant mixing times may increase the breakage or damage to ingredients due to the friction generated between the particles. The particle size of ingredients may break down during long mixing periods. For example, a certain percentage of an ingredient with a certain particle size may break down under long mixing periods such that a variety of particle sizes may be present after mixing. Such a variety in particle size may can cause problems with product waste, dust, and accurate measuring, among other issues.

As used herein, the term dosing refers to measuring, such as measuring a mixture of previously mixed ingredients. Dosing may further refer to the mixing of a variety of components in a manner such that the proper ratio of the various components is obtained. Specialized equipment has been sometimes used for combining the previously portioned ingredients and then delivering those combined ingredients. Such approaches were costly, time consuming, and bulky due to the additional equipment required for such a system configuration. Further, in several processes that employed a batch mixing system, the batch was moved from location to location depending on the equipment used. In one known configuration, a batch of material is moved from stage to stage by dropping the batch from an upper floor to a lower floor. For example, the force of gravity may be used to transfer the ingredients from a mixer to a packaging station. Thus, considering the breakage resulting from the longer mixing times and the breakage due to transfer of the ingredients, batch processing may result in a significant variation in the ingredients and that variation can require additional work to correct. In short, despite the complexity of the previous approaches, these approaches did not offer the reliability, configurability, consistency, and ease of use that was desired.

BRIEF DESCRIPTION OF THE DRAWINGS

The above needs are at least partially met through provision of the apparatus and method for a delivery of a dry mixture described in the following detailed description, particularly when studied in conjunction with the drawings, wherein.

Figure 1:
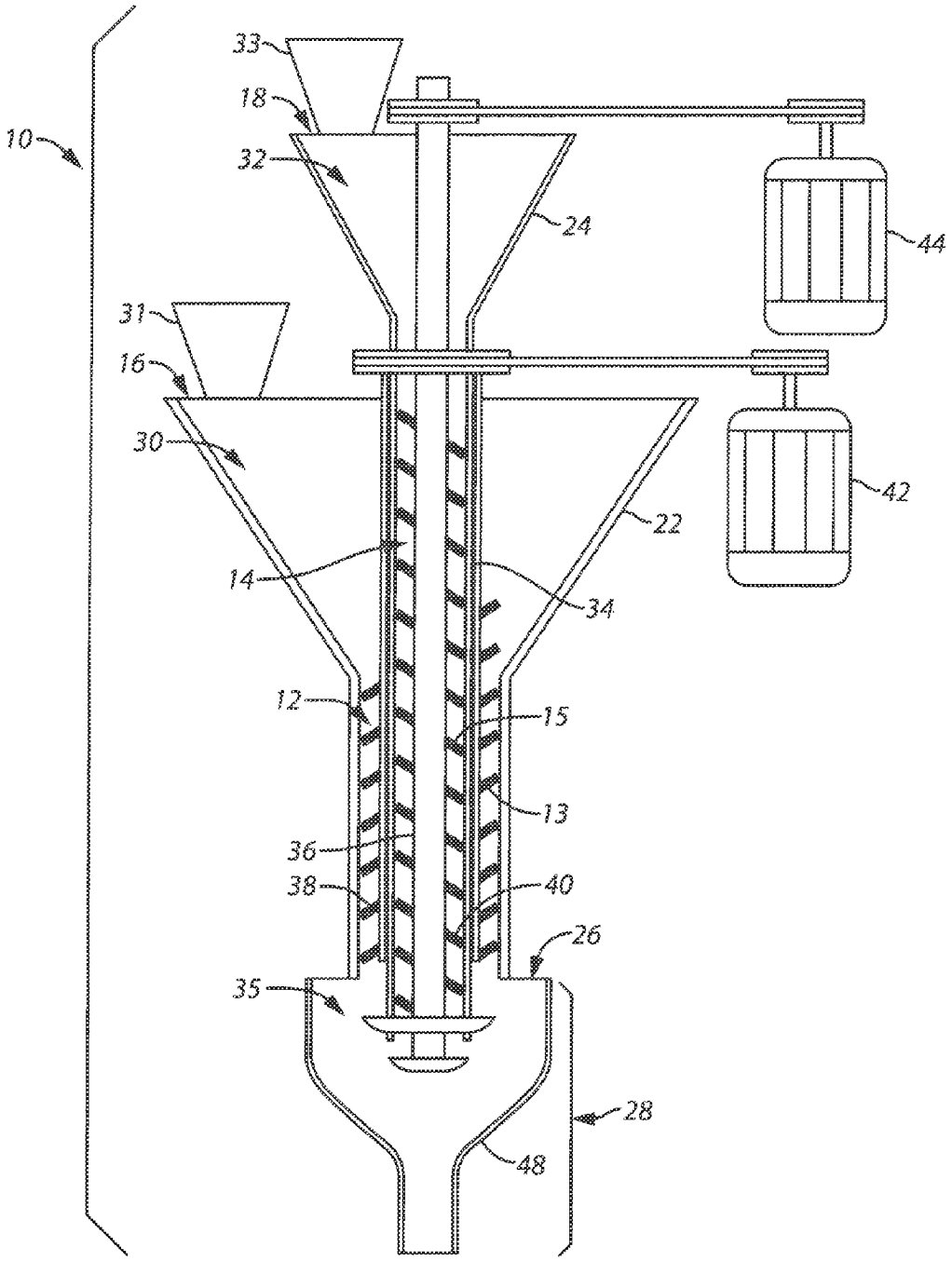
FIG. 1 comprises a schematic cross section as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments. Also, common but well-understood elements that are useful or necessary in a commercially feasible embodiment are often not depicted to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a method of measuring or dosing a dry mixture includes providing separate flow channels for certain ingredients. The flow channels including at least a first flow channel and a second flow channel are configured such that the first flow channel is at least partially disposed around the second flow channel and the two flow channels may be incorporated into a single piece of equipment. The method further includes providing a first material to the first flow channel and a second material to a second flow channel. In one illustrative embodiment, one of the first and second materials comprises a single dry ingredient and the other of the first and second material comprises multiple dry ingredients. In another embodiment, both the first and second materials comprise multiple previously-mixed ingredients. By yet another approach, both the first and second materials comprise single dry ingredients. The previously mixed ingredients have typically undergone mixing prior to being introduced to the dosing apparatus 10. The first and second materials are advanced through the channels to a shared exit where a mixing zone is provided.

The mixing zone may be configured to combine and mix the previously separate streams and encourage mixing of the ingredients. By one approach, the mixing zone is configured with a mixing cone through which the ingredients pass. In one illustrative example, the mixing cone has an output that is narrower in cross section than an input or a main body portion of the cone. By yet another approach, the mixing zone is configured with a mixing form, which is positioned within an outer wall. The mixing form may be placed within the flow path to narrow the passageway through which the ingredients must pass which pushes the ingredients into contact with one another. In yet another approach, the mixing zone may include discs or plates positioned to direct the first and second materials to an outside wall, where they can mix with the other ingredients.

As discussed herein, the separate flow channels retain the first and second materials separate from one another until the ingredients have advanced to the shared exit where the previously separate materials are initially combined and mixed. Thus, the initial combination of previously separate ingredients occurs at the shared exit and the beginning of the mixing zone. Subsequent to the mixing zone, the mixed materials are directed into a container such as a pouch, bottle, can, bin, or jar, to note but a few of the options. Such portioned materials may be used in numerous different application settings. For example, in one application setting, the mixed materials may be a food or beverage product that is prepared for delivery to a consumer. Whereas in another illustrative application, the materials may be portioned for use in subsequent manufacturing processes.

The first and second flow channels may include a rotary element. In one illustrative embodiment, the first and second flow channels have helical configurations such as helically shaped carriers or helical screws. Further, it is anticipated that the first and second materials may be advanced through the flow channels by rotating the helical configuration of the flow channels around a common axis.

By one approach, the first material comprises a single dry ingredient and is at least 50% of the combined first and second materials, such that the first material is at least half of the total mixed ingredients. By another approach, the second material is comprised of a plurality of ingredients. In one illustrative embodiment, the second material includes at least two ingredients. Further, in one illustrative example, the second dry material includes a plurality of dry ingredients and the second dry material less than about half of the total mixed ingredients.

So configured and arranged, those skilled in the art will recognize that these teachings will provide for efficiently and reliably ensuring that dry powdered ingredients are properly dosed such that they are measured and mixed into a combined dry mixture. More particularly, a process such as that described herein permits accurate dosing of ingredients such that correction via rework is not typically required. Further, such aims are met with the approach described herein such that plant space is employed effectively and, since the ingredients are measure in an accurate manner, the ingredients are used economically. Further, since previous processes require numerous steps, a process such as that described herein significantly streamlines the production of the dry mixtures.

These and other benefits may become clearer upon making a thorough review and study of the following detailed description. Referring now to the drawings, and in particular to FIG. 1, an illustrative apparatus that is compatible with many of these teachings will now be presented. A dosing apparatus 10 schematically illustrated in FIG. 1 includes a first flow channel 12 and a second flow channel 14 being coaxially aligned with one another. The first flow channel 12 is at least partially disposed around the second flow channel 14. The first and second flow channels 12, 14 have a first input 16 and a second input 18, respectively. Further, the first input 16 and the second input 18 may each be connected to a reservoir, such as hopper 30, 32, which feed dry ingredients into the flow channels. Further, the hoppers 30, 32 for the two inputs may be differently sized.

As mentioned above, the first and second flow channels 12, 14 may be configured to be coaxially aligned. Further, at least a portion of the first and second flow channels 12, 14 may have a helical configuration such as helically shaped carriers or helical screws. The helical screws, being coaxially aligned, are rotatable around a common axis of rotation or screw axis. The first flow channel 12, in one illustrative embodiment, includes an outer concentric rotary element or metering screw 13 that, in part, defines the first flow channel 12. Further, in one illustrative example, the second flow channel 14 includes an inner concentric rotary element or metering screw 15 that, in part, defines the second flow channel 14.

By one approach, the helical configuration includes shafts 34, 36 with helical threads 38, 40 forming a helical screw, such as inner and outer concentric metering screws 13, 15. To rotate the metering screws 13, 15, the shafts 34, 36 are rotated by attached motors 42, 44. FIG. 1 illustrates that two separate motors 42, 44 may be used for the two metering screws 13, 15. In this way, the motor speed may be different and may rotate the screws at different rates. In one illustrative embodiment, the screws may rotate at a different rate, advancing product at a different rate, and, further, in such a configuration differently sized hoppers may be used to accommodate the different amount of ingredients advanced. Further, it is anticipated that the helical screws may have turns of a predetermined pitch such that the screw has evenly spaced turns that properly meter or measure a predetermined amount of material. The screw pitch may be selected depending on the amount of ingredients to be delivered and dosed. In addition, it is anticipated that the inner and outer concentric metering screws 13, 15 may have differently pitched screw threads. Alternatively, the two metering screws 13, 15 may have similarly pitched screw threads. In addition, the two metering screws 13, 15 may be rotated at different rates and, therefore, the ingredients may be advanced and delivered at different rates. Further, in one illustrative example, the metering screws 13, 15 have helical rotations that are out of phase from one another.

The inputs 16, 18 may connect to a first end of the flow channels 12, 14 where the dry ingredients are introduced into the apparatus 10. The dry ingredients are advanced to the portions of the flow channels 12, 14 having helical configurations. In one illustrative embodiment of FIG. 1, the first input 16 and the second input 18 are staggered from one another. By one approach, the second flow channel 14 with the inner concentric screw 15 begins a longitudinal distance prior to the first flow channel 12 with the outer concentric screw 13.

A housing or guide such as a containment cylinder or tube may surround the flow channels. By one approach, an outer containment cylinder 22 is disposed about the first flow channel 12 including the outer concentric metering screw. In such a configuration, the outer containment cylinder may be a hollow channel having a generally circular cross section. For example, a hollow cylinder with the helical screw of the first flow channel 12 disposed therein permits the ingredients to be advanced through the space between the screw threads and the inner wall of the cylinder.

In addition, an intermediate containment cylinder 24 is disposed about the second flow channel 14 and partially within the first flow channel 12 and the outer containment cylinder 22. The first flow channel 12 and outer helical screw may have a bore for receiving the intermediate containment cylinder 24 and second flow channel 14 and inner helical screw 15. The intermediate containment cylinder 24, like the outer containment cylinder 22, may be hollow with a generally circular cross section. Ingredients within the second flow channel 14 may be advanced therein by rotation of the inner helical screw moving the ingredients within the space between the threads of the inner helical screw and the inner wall of the cylinder. The containment cylinders 22, 24 also may have hoppers to contain product and/or channels or funnel portions 31, 33, which may have a variety of shapes, for directing the dry powdered ingredients into the hoppers 30, 32 or metering screws 13, 15.

By having separate flow channels, the ingredients within those flow channels are not mixed together until the ingredients reach a shared exit. Mixtures of dry materials that have ingredients with different flow characteristics and mixtures with different particle size distributions may have ingredients that segregate out from the normal flow channels. As discussed herein, the two separate flow channels contain different ingredients or combinations of different ingredients. In these regards, ingredients that may segregate out from the combined flow due to their particle size distribution may be kept separate and dosed independently of one another and subsequently mixed together. By keeping the ingredients in separate flow channels until the initial mixing at the shared exit, the ingredients within each of the flow channels are fairly consistent throughout that flow channel and can be accurately dosed by the turn of the screw. In short, by having separate flow channels, the various ingredients can be properly measured to accurately dose the various ingredients.

At the discharge end of the dosing apparatus 10, opposite the end with inputs 16, 18, the flow channels 12, 14 including the inner and outer concentric metering screws 13, 15 terminate at the shared exit 26. The metering screws 13, 15 terminate near one another such that the inner and outer metering screws 13, 15 may terminate within a few inches of one another, at the same location, or somewhere in-between. Further, when the intermediate containment cylinder 24 terminates the first and second materials are able to mix together for the first time. Thus, once the first and second materials reach the shared exit 26, the ingredients are combined and mixed together.

In one illustrative embodiment, one of the flow channels delivers a major component of the mixed ingredients and the other flow channel delivers the minor component of the mixed ingredients. More particularly, the major component flow channel may comprise about 50% or more of the combined ingredients and the minor component flow channel may comprise less than about 50% of the combined ingredients. In one illustrative embodiment, the major component may have only a single dry ingredient that comprises more than about 50% of the mixed ingredients and the minor component includes at least two different ingredients. For example, the first flow channel 12 and the outer concentric metering screw 13 may contain the major component comprising a single ingredient and the second flow channel 14 and the inner concentric metering screw 15 contain the minor components. By another approach, the minor flow channel delivers at least three minor components that make up less than about 50% of the mixed ingredients. In yet another illustrative example, the major and minor components are comprised of multiple different ingredients. For example, both the first flow channel 12 and the second flow channel 14 may contain multiple ingredients.

Figure 2:
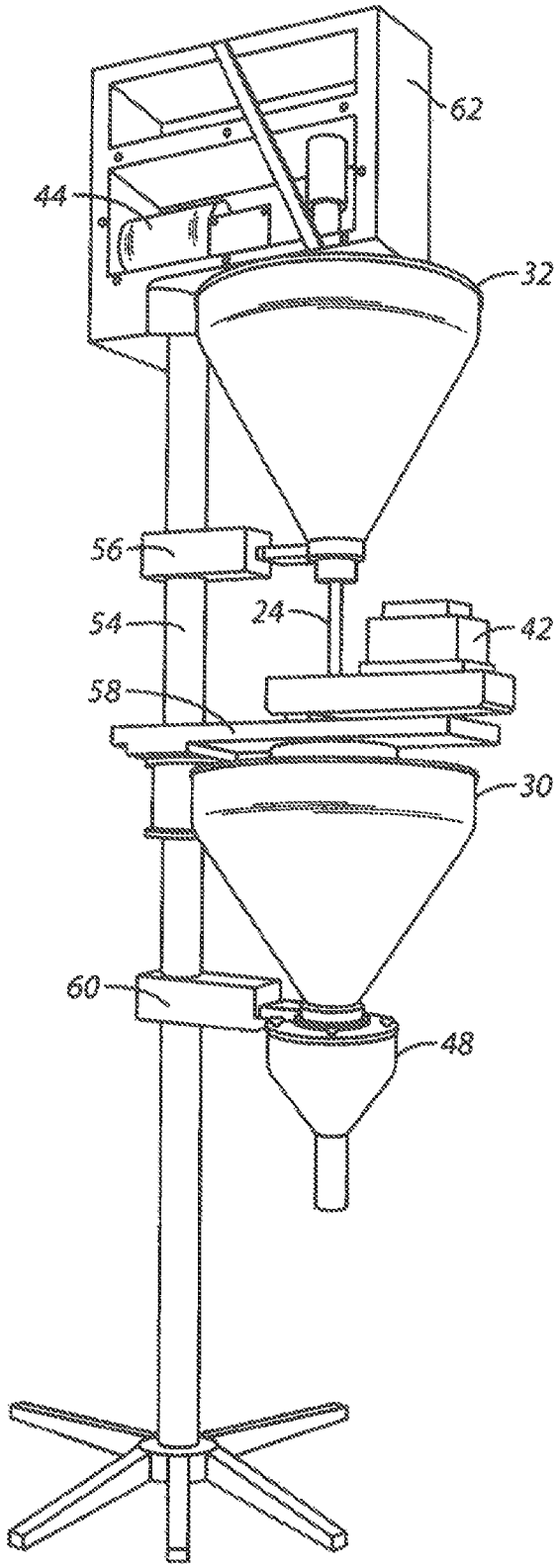
FIG. 2 is a perspective view of an apparatus configured in accordance with various embodiments of the invention.

By one approach, the first and second flow channels 12, 14 are vertically oriented such that the shared exit 26 is positioned below the first and second inputs 16, 18 and the common axis of the flow channels 12, 14 is vertical or nearly vertical. As illustrated in FIG. 2, such a vertical configuration may include a support member 54 to which the other elements of dosing apparatus 10 are secured. For example, arms 56, 58, 60 support portions of apparatus 10 such as containment cylinders 22, 24. In addition, motors 42, 44 may be secured to the dosing apparatus 10 in a number of manners such as by an arm extension that attaches to the arms used to support other elements or by another support such as support frame 62 illustrated in FIG. 2. As shown, support frame 62 may also support the shafts, such as inner shaft 36.

Figure 3:
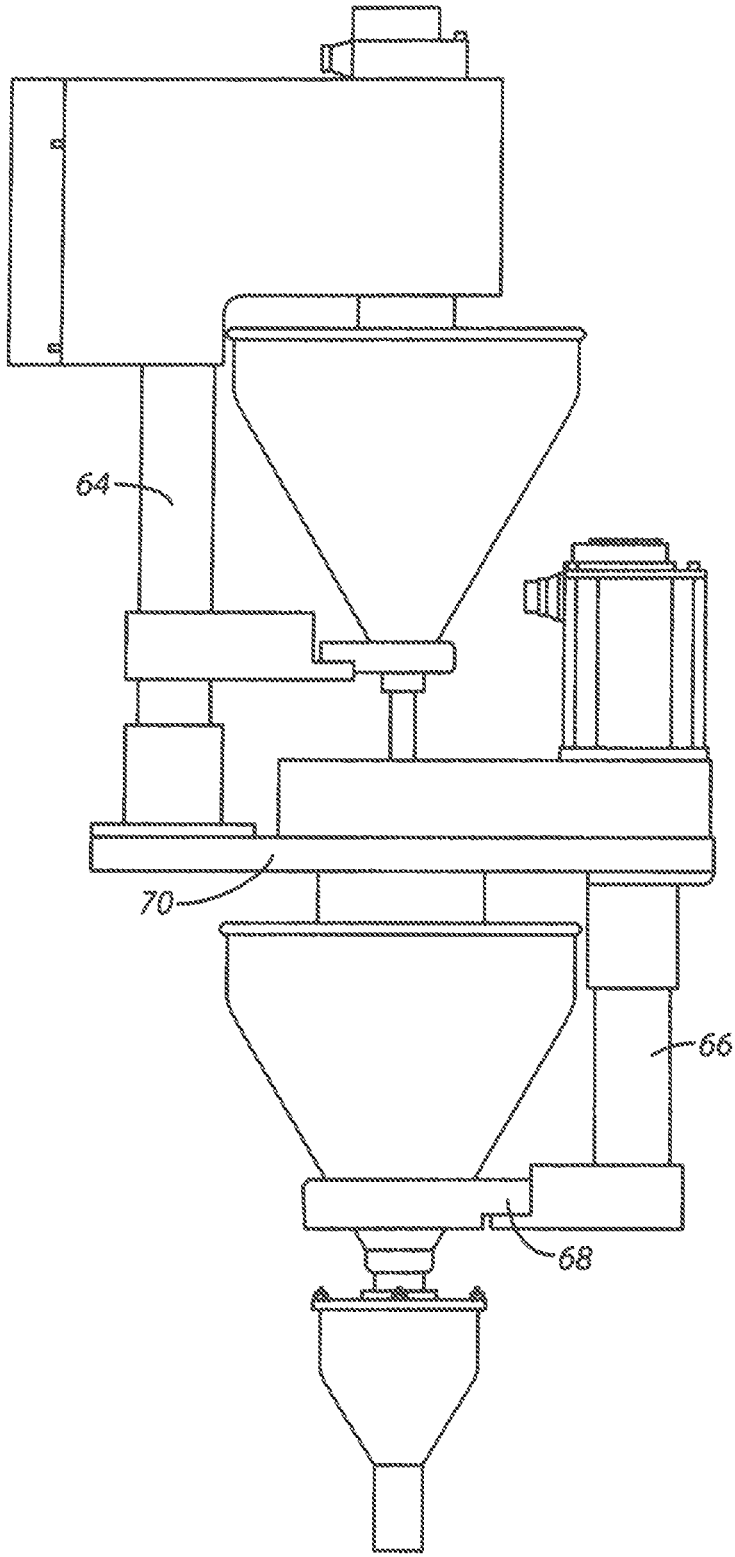
FIG. 3 is a schematic cross section of another embodiment of an apparatus configured in accordance with various embodiments of the invention.

While FIG. 2 illustrates a generally vertical support member 54 having arms 56, 58, 60 extending therefrom to support portions of dosing apparatus 10, an alternative configuration may include several support members. As shown schematically in FIG. 3, instead of having a single vertical support with unitary construction, several smaller generally vertical supports 64, 66 may be employed. Further, support arms 68, 70 may be used to secure the various elements of dosing apparatus 10 to the generally vertical supports 64, 66. It is anticipated that the dosing apparatus 10 may be supported in a variety of manners such as through the floor, the ceiling, and the roof, as well as from equipment located within the vicinity the dosing apparatus 10.

In one illustrative embodiment, it is anticipated that the primary force acting on the ingredients as they reach the common exit 26, at the point of exit from the metering screws 13, 15, is the force of gravity such that the ingredients are basically in free fall. Further, in some illustrative embodiments, once the ingredients exit the concentric containment cylinders 22, 24, the ingredients may be under centrifugal force such that the ingredients move toward an outside wall 48 of the mixing zone 28, as discussed further below.

Figure 4:
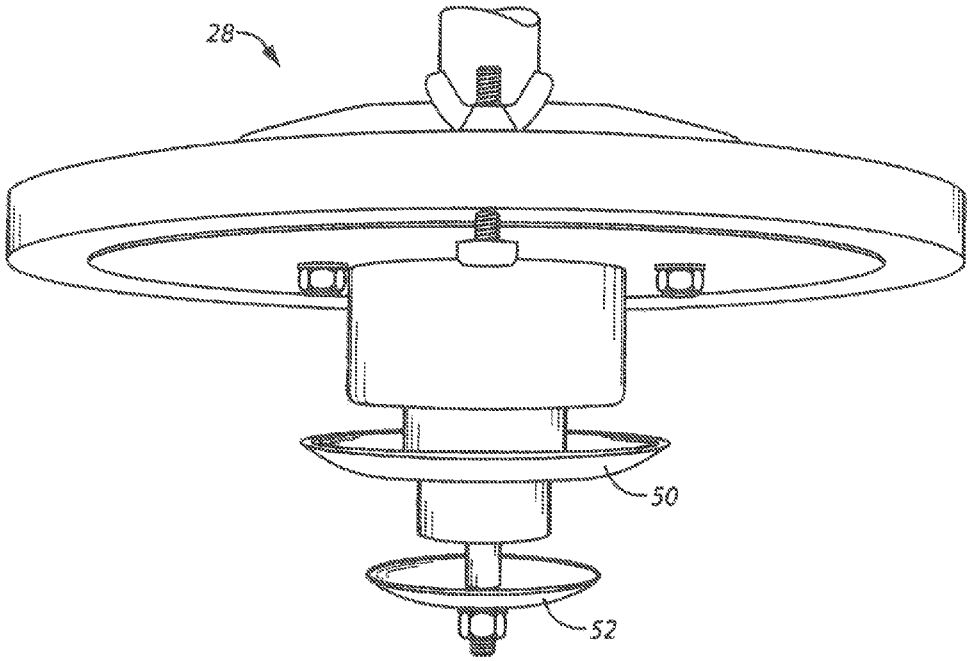
FIG. 4 is a perspective view of a portion of the rotating mixing cone as configured in accordance with various embodiments of the invention.

As the ingredients arrive at the shared exit 26 from their separate flow channels 12, 14, the separate ingredients are initially combined with one another. To aid in this combination and to encourage mixing of the previously separated ingredients, a mixing zone 28 may be employed to force the separate ingredients into contact with each other. The mixing zone 28 may have a variety of configurations. By one approach, the mixing zone 28 may be a mixing cone 35 with a gradually increasing or decreasing cross sectional area. It is anticipated, that such a mixing cone may be a stationary mixing cone or may be a rotating mixing cone. In another embodiment, the mixing zone 28 includes an upper plate 50 and a lower plate 52, as shown in FIGS. 1 and 4. The upper and lower plates 50, 52 may be rotating or may be stationary. In one illustrating embodiment, an upper rotating plate 50 facilitates movement of the dry ingredient(s) in the first flow channel 12 to the outside wall 48 of the mixing zone 28. The lower rotating plate 52 facilitates movement of the dry ingredient(s) to the outside wall 48 of the mixing zone 28. Thus, the dry ingredients become mixed with one another at the outside wall 48 of the mixing zone 28. By another approach, a mixing zone may be configured such that the size of cross sectional opening decreases such that the ingredients must pass through a relatively small opening, to thereby facilitate mixing of the ingredients.

At the exit of the dosing apparatus 10, the mixed ingredients may be directed into a container. In such a configuration, the container will receive an overall mixture of the previously separate ingredients that has been accurately measured and mixed together. In addition, the containers will be uniformly filled with a predetermined amount of ingredients.

Figure 5:
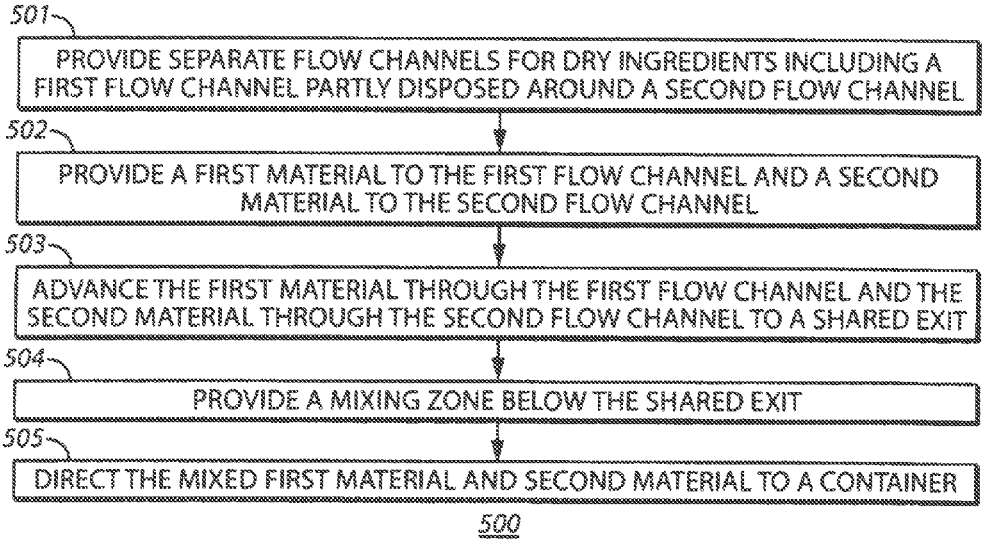
FIG. 5 comprises a flow diagram as configured in accordance with various embodiments of the invention.

Turning now to illustrative process 500, shown in FIG. 5, process 500 includes providing 501 separate flow channels for dry ingredients including a first flow channel disposed partly around a second flow channel. As mentioned above, the flow channels may have, at least partially, a helical configuration such as a helically shaped carrier or helical screws. In addition, the first and second flow channels may share a common axis of rotation.

Process 500 continues by providing 502 a first material to the first flow channel and a second material to the second flow channel. The first and second materials, in one illustrative embodiment, are dry powdered materials. By one approach, either one of the first or second materials comprises a single dry ingredient and the other of the first and second materials comprises multiple dry ingredients. Further, one of either the first or second materials, the major ingredient(s), may comprise about 50% of the combined mixture from the two channels. In one illustrative embodiment, the single dry ingredient may be sugar or citric acid and the multiple minor ingredients may include vitamins such as vitamins A, C, and E, minerals, colorings, flavorings, gums, fibers, sodium citrate, sweeteners, active components, citric acid, and other acids such as malic or tartaric acid.

By yet another approach, both the first and second materials comprise multiple dry ingredients, depending on the desired final mixture. Thus, the major ingredients that comprise at least 50% of the combined mixture may include sugar, citric acid, maltodextrin, gelatin, and/or dried pulp cell, to note but a few options. Further, the minor ingredients that comprise less than 50% of the combined mixture may include vitamins, such as vitamins A, C, and B, minerals, such as calcium and iron, colorings, active components, flavorings, gums, fibers, sodium citrate, sweeteners, citric acid, and/or other acids, such as malic or tartaric, to note but a few of the ingredients contemplated. For example, in another illustrative embodiment, the major ingredient may be ground coffee and the minor ingredients may include sweeteners, flavorings, and other powdered additives.

Process 500 also includes advancing 503 the first material through the first flow channel and the second material through the second flow channel to the shared exit, where the ingredients are initially combined and able to contact one another. As discussed above, the flow channels may include helical portions such that the helical portions may rotate to advance the material through the channels such as used in auger feeders. Both the inner and the outer concentric metering screws terminate relatively close to one another without terminating at exactly the same location. When the intermediate containment cylinder terminates, the separation between the first and second flow channels also terminates and the two ingredients are permitted to mix.

Process 500 further includes providing 504 a mixing zone at the shared exit or just below the shared exit, depending on the configuration. Such a mixing zone encourages mixture of recently combined first and second materials. Further, the first and second combined materials are then directed 505 into a container.

Providing 502 one or both of the first or second materials may also include pre-mixing the materials. More particularly, as discussed above one or both of the first or second materials may include two or more ingredients and the multiple ingredients may be pre-mixed prior to advancing 503 the materials through the flow channels. Further, while prior processes required that the first and second ingredients be mixed prior to measuring, process 500 permits the ingredients to be separately dosed and mixed as the ingredients are exiting the channels and directed into a container, without requiring separate machines for the separate dosing.

To demonstrate the increased accuracy and flexibility of the apparatus 10 and method 500, a number of tests were run. As illustrated below, five tests were run with varying ingredient formulas. The ingredients mixed in the "premix-preparation step" include a plurality of ingredients that were subsequently mixed with at least one additional ingredient in the "finish product-fill step." In the test cases, the sugars added in the "finish product-fill step" are the major component and the major component comprises at least 57% of the final product composition in each of the tests. Further, the minor component, comprised of a plurality of ingredients, comprises 43% or less of the final product composition in each of the tests. Sugar in the test examples is used as an ingredient in the major and minor components. The sugar may or may not be used in the minor ingredients, though it may be helpful to ensure flowability of ingredients. Further, the tests used different sugars (A, B) to test sugar particles of different sizes. The test illustrated that the apparatus 10 and method 500 were quite accurate in properly dosing a variety of ingredients including sugars of different particle sizes.

| | TEST 01 | TEST 02 | TEST 03 | TEST 04 | TEST 05 |
|---|---|---|---|---|---|
| Premix - Preparation step | | | | | |
| Sugar | 47.25 | 0.00 | 0.00 | 0.00 | 0.00 |
| Acids | 31.33 | 59.40 | 59.40 | 54.62 | 54.62 |
| Pulp | 2.83 | 5.36 | 5.36 | 4.30 | 4.30 |
| Sweeteners | 3.11 | 5.90 | 5.90 | 6.18 | 6.18 |
| Vitamins/ Iron | 1.25 | 2.37 | 2.37 | 1.89 | 1.89 |
| Colours | 6.74 | 12.78 | 12.78 | 6.33 | 6.33 |
| Flavors | 2.68 | 5.08 | 5.08 | 4.90 | 4.90 |
| Gums | 1.47 | 2.78 | 2.78 | 3.65 | 3.65 |
| Citrate | 3.34 | 6.32 | 6.32 | 5.81 | 5.81 |
| Others | 0.00 | 0.00 | 0.00 | 12.32 | 12.32 |
| Total | 100.0000 | 100.0000 | 100.0000 | 100.0000 | 100.0000 |
| Finish Product - Fill step | | | | | |
| Premix | 42.86 | 20.04 | 20.04 | 28.68 | 28.68 |
| Sugar A | 57.14 | 79.96 | 0 | 71.32 | 0 |
| Sugar B | 0 | 0 | 79.96 | 0 | 71.32 |
| Total | 100.0000 | 100.0000 | 100.0000 | 100.0000 | 100.0000 |

Once the products were measure and mixed, the products were taste tested. All five of the test samples were given good product taste ratings. Further, the vitamin C, acidity, and visual color tested were also considered good. As mentioned above, the previous process that employed larger mixing times and vertical drops to transport ingredients resulted in breakage of the ingredients such that a larger variation in particle size was found. While some batch mixing is still employed in the "premix-preparation step" the duration of that mixing was greatly reduced. Such reduction in variation can still occur, despite some batch mixing in the pre-mixture stage, because the particle size of the elements is similar or because the size of the batch is not quite as large.

By reducing the breakage of the particle size and increasing the accuracy of the resulting product, overdosing (where additional ingredients are added to the product to make sure that the product has a sufficient amount of stated ingredients) and rework (where once produced products must be reprocessed to correct any errors) are reduced, thereby saving product and time. In addition, avoiding breakage decreases ingredient dust that can result when particles degrade. In sum, a decrease in variation of the final product, prevents waste and saves on labor and maintenance.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

We claim:

1. A method comprising:

providing separate metering flow channels for dry ingredients including at least a first metering flow channel and a second metering flow channel, wherein the first metering flow channel is at least partially hollow to at least partially contain the second metering flow channel;

providing a first material to the first metering flow channel and a second material to the second metering flow channel, wherein one of the first and second materials comprises multiple dry ingredients, wherein the first and second metering flow channels are operated independently at different feed rates;

advancing the first material through the first metering flow channel and the second material through the second metering flow channel to a shared exit;

providing a mixing zone, the mixing zone initially combining and mixing the first material and second material together to provide mixed first and second materials, the mixing zone having a conically shaped outside wall in which an outlet is narrower in cross section than a main body portion disposed at the shared exit of the first and second metering flow channels, the mixing zone having first and second rotatable plates positioned within the outside wall to direct the first and second materials to the outside wall;

rotating the first and second rotatable plates to generate a centrifugal force such that the first material and second material are moved toward the outside wall and mixed together; and directing the mixed first material and second material to a container.

2. The method of claim 1 wherein at least a portion of the first metering flow channel and the second metering flow channel have a helical configuration.

3. The method of claim 2 wherein the at least a portion of the first metering flow channel and the second metering flow channel having helical configurations are helically shaped carriers.

4. The method of claim 3 wherein at least a portion of the first metering flow channel and the second metering flow channel are helical screws.

5. The method of claim 2 wherein the first metering flow channel and the second metering flow channel have a common axis of rotation that is generally vertically oriented.

6. The method of claim 2 wherein the first material and the second material are advanced through the metering flow channels by rotating the helical configuration of the metering flow channels around a common axis.

7. The method of claim 1 wherein the first material provided comprises a single dry ingredient and further comprises at least 50% of the combined first and second materials.

8. The method of claim 1 wherein the second material provided comprises at least two previously mixed ingredients.

9. The method of claim 1 wherein the first material and the second material provided comprise at least two previously mixed ingredients.

10. The method of claim 1 wherein the first material comprises a single dry ingredient and the second material comprise another single dry ingredient.

11. An apparatus comprising:

a first input and a second input;

the first input connected to an inner concentric metering screw and the second input connected to an outer concentric metering screw, wherein the outer concentric metering screw is at least partially hollow to at least partially contain the inner concentric metering screw, which is coaxially aligned with the outer concentric metering screw, wherein the inner and outer concentric metering screws are controlled individually by motors;

an intermediate containment cylinder disposed between the inner concentric metering screw and the outer concentric metering screw and an outer containment cylinder disposed around the outer and inner concentric metering screws;

a common output wherein materials separated by the intermediate containment cylinder are mixed when discharged at the common output;

a mixing zone at the common output, the mixing zone having first and second rotatable plates positioned within the mixing zone, the first and second rotatable plates configured to rotate and generate a centrifugal force to direct the first material and second material to an outside wall to mix the first material and second material, the mixing zone having an output configured to direct the ingredients into a container.

12. The apparatus of claim 11 further comprising a first pump and a second pump configured on a first line and a second line connected to the first input and the second input.

13. The apparatus of claim 11 wherein the first input or the second input includes a hopper.

14. The apparatus of claim 11 wherein the mixing zone comprises a mixing cone.

15. The apparatus of claim 11 wherein the inner concentric metering screw and the outer concentric metering screw are configured to transport dry powdered ingredients.

16. The apparatus of claim 15 wherein the inner concentric metering screw and the outer concentric metering screw are configured to transport dry powdered ingredients having different particle size distribution.

17. The apparatus of claim 11 wherein the inner concentric metering screw, the outer concentric metering screw, and the intermediate containment cylinder terminate at substantially the same point.

18. The apparatus of claim 11 wherein the output of the mixing zone has a narrower cross section than the cross section of the common output.

19. An apparatus comprising:

a first metering flow channel for receiving and moving first dry ingredients to a shared exit;

a second metering flow channel for receiving and moving second dry ingredients to the shared exit common with the first metering flow channel, the second metering flow channel being at least partially hollow to at least partially contain the first metering flow channel, the first and second metering flow channels comprising metering screws having differently pitched threads, thereby advancing the first and second ingredients at different feed rates, wherein one of either the first dry ingredients or the second dry ingredients comprises a single dry ingredient and the other of the first and the second dry ingredients comprises multiple dry ingredients;

a mixing area for initially combining and mixing the first and second dry ingredients together to provide combined first and second dry ingredients, the mixing area having first and second rotatable plates positioned within the mixing area, the first and second rotatable plates configured to rotate and generate a centrifugal force to direct the first dry ingredients and second dry ingredients to an outside wall to mix the first material and second material, the mixing area configured to direct the first and second dry ingredients into a container.

* * * * *